US005231744A

United States Patent [19]

Ohta

[11] Patent Number: 5,231,744

[45] Date of Patent: Aug. 3, 1993

[54] RESIDUAL STRAND REMOVING DEVICE FOR VARIOUS TYPES OF ROVING BOBBIN

[75] Inventor: Motomi Ohta, Kanazawa, Japan

[73] Assignee: Murao and Company Limited, Ishikawa, Japan

[21] Appl. No.: 939,918

[22] Filed: Sep. 3, 1992

[30] Foreign Application Priority Data

Dec. 26, 1991 [JP] Japan ..... 3-107361

[51] Int. Cl.[5] ..... D01H 11/00

[52] U.S. Cl. ..... 28/294; 242/35.5 A

[58] Field of Search ..... 28/292, 294; 242/35.5 A

[56] References Cited

U.S. PATENT DOCUMENTS

| | | | |
|---|---|---|---|
| 2,834,090 | 5/1958 | Vowles | 28/294 |
| 4,259,770 | 4/1981 | Terrell | 28/294 |
| 4,586,668 | 5/1986 | Mori | 28/292 X |
| 5,148,665 | 9/1992 | Kidami | 28/292 X |

FOREIGN PATENT DOCUMENTS

| | | | |
|---|---|---|---|
| 1-183531 | 7/1989 | Japan | 28/294 |
| 3-92782 | 9/1991 | Japan . | |

*Primary Examiner*—Clifford D. Crowder

*Assistant Examiner*—John J. Calvert

*Attorney, Agent, or Firm*—Longacre & White

[57] ABSTRACT

A plurality of residual strand removing devices for roving bobbins, which correspond in number to the number of fiber types of residual strand of the roving bobbins, are disposed in a transfer line for transferring the spent roving bobbins from a fine spinning frame to a roving frame. The residual strand removing devices are disposed in series to correspond to the respective fiber types. A control unit is arranged for selectively operating the residual strand removing device corresponding to the detected fiber type of the residual strand of the roving bobbin. The residual strand removing device includes a dust collecting box, a lower suction opening, and an upper exit opening. A lower air passage connects the suction opening and an inlet side of the dust collecting box. An upper air passage connects an outlet side of the dust collecting box and the exit opening. A filter, which can prevent passage of the removed residual strand, is disposed in the dust collecting box for partitioning the same into the inlet and outlet sides. A blower is arranged for supplying air flowing from the suction opening through the dust collecting box toward the exit opening.

2 Claims, 4 Drawing Sheets

PRIOR ART

PRIOR ART

RESIDUAL STRAND REMOVING DEVICE FOR VARIOUS TYPES OF ROVING BOBBIN

BACKGROUND OF THE INVENTION

1. Field of the Invention

The present invention relates to a residual strand removing apparatus for drawing and removing strand adhered to a spent roving bobbin from the bobbin to be transferred from a fine spinning frame to a roving frame. In particular, the invention relates to a residual strand removing apparatus, which is applied to the roving bobbins of various types of fiber. The residual strand removing apparatus includes a plurality of residual strand removing devices, which correspond in number to the types of the fiber of the residual strand, and are arranged in series in a transfer line to correspond to the fiber types of the residual strand, so that the residual stand removing device corresponding to the type of the detected residual strand is operated for removing the residual strand of each fiber type.

2. Description of the Background Art

In a spinning factory, a roving frame forms a roving bobbin bearing roving wound in a bundle. The roving bobbin is supplied to a fine spinning frame. The roving bobbin which has been spent in the fine spinning frame is returned to the roving frame, which winds the bundle of the roving again and supplies it to the fine spinning frame. These operations are repeated. The total number of the roving bobbins supplied to the fine spinning frame corresponds to the output of the spinning factory, and thus a large number of roving bobbins are transferred by the transfer lines during repetition of the foregoing steps. Since residual strand have adhered to the roving bobbin spent in the fine spinning frame, a residual strand removing device for the roving bobbin is installed in the transfer line from the fine spinning frame to the roving frame, so that the roving bobbin may be returned to the roving frame after completely removing the residual strand from the roving bobbin.

As an example, there has been proposed a residual strand drawing and removing device in the Japanese Laid-Open Utility Model Publication No. 3-92782 (1991). As shown in FIGS. 3 and 4, a roving bobbin 5 to which residual strands 11 have adhered is transferred through a residual strand drawing and removing device 100. The removing device 100 can simultaneously receive a predetermined number of bobbins 5, which are grouped, and the bobbins 5 are transferred and stopped by group units. In the removing device 100, there are provided suction nozzles 13, which are equal in number to the number of the bobbins 5 in one group and are disposed in parallel, projecting toward the rows of the bobbins 5. When one bobbin group enters the removing device 100, the transference is stopped, so that each bobbin 5 is opposed to each suction nozzle 13 and is supported by a rotary device 12 disposed under the corresponding suction nozzle 13. Each bobbin 5 is driven to rotate together with the rotary device 12 by an electric motor 21. In this state, the suction nozzle 13 is moved in forward, rearward and vertical directions to drawn and remove the residual strand 11 by air. After the completion of the suction, each suction nozzle 13 is approached to a roving winding auxiliary tool 17, and the bobbin 5 is rotated forwardly and reversely for completely drawing and removing the residual strand 11. The suction nozzles 13 are simultaneously moved in such a manner that a holder box 14 holding the respective suction nozzles 13 is moved forwardly and rearwardly along guide rails 19 by a pneumatic cylinder 18 connected to a pneumatic source through an air piping 22, and is moved vertically by an electric motor 23 through a chain 20. Each suction nozzle 13 is connected to a duct 15 by a suction hose 16, and an outlet of the duct 15 is connected to a residual strand storage (not shown) through a piping.

Generally, in the spinning factory, roving including different types of fiber is handled simultaneously. The residual strand which is removed from the roving bobbins by the residual strand removing devices is opened into a single fiber state and is supplied as raw cotton for improving a yield. Therefore, mixture of different types of fiber must be avoided to prevent reduction of the quality. For this reason, the different types of fiber must be handled by different systems each including the fine spinning frame, roving frame, residual strand removing device and transfer line, and thus the number of systems are equal in number to the number of the types of the fiber. Further, they are disposed in parallel on a common plane for simplifying installation.

The parallel disposition of the transfer lines and residual strand removing devices, of which number corresponds to that of the types of the fiber, requires a large space and thus is disadvantageous in view of a factory layout. Also, this increases a cost and complicates Operations. Accordingly, it is an object of the invention to provide a residual strand removing apparatus for various types of roving bobbins, which does not require a large space and can completely remove residual strand.

SUMMARY OF THE INVENTION

The present invention provides a residual strand removing apparatus for roving bobbins, achieving the above-noted object, which is disposed in a transfer line for transferring a spent roving bobbin from a fine spinning frame to a roving frame, the apparatus including a plurality of residual strand removing devices, which correspond in number to the number of fiber types of the residual strand of the roving bobbins and are disposed in series to correspond to the respective fiber types; and a control unit for selectively operating the residual strand removing device corresponding to the detected fiber type of the residual strand of the roving bobbin. Also, the residual strand removing device includes a dust collecting box, a suction opening located at a lower portion of an inner side of the residual strand removing device, an exit opening located at an upper portion of the inner side of the residual strand removing device, a lower air passage connecting the suction opening and an inlet side of the dust collecting box, an upper air passage connecting an outlet side of the dust collecting box and the exit opening, the above openings and passages forming a residual strand collecting air passage, a filter disposed in the dust collecting box for partitioning the same into the inlet and outlet sides and capable of preventing passage of the removed residual strand, and a blower for supplying air flowing from the suction opening through the dust collecting box toward the exit opening.

The residual strand removing devices, which correspond to different fiber types, respectively, are disposed in series, and the residual strand removing devices corresponding to the fiber types of the residual strand of the bobbin, which are detected during transference, are selectively driven for carrying out the removal of the residual strands for the respective fiber types.

The foregoing and other objects, features, aspects and advantages of the present invention will become more apparent from the following detailed description of the present invention when taken in conjunction with the accompanying drawings.

DETAILED DESCRIPTION OF THE EMBODIMENTS

Figure 1:
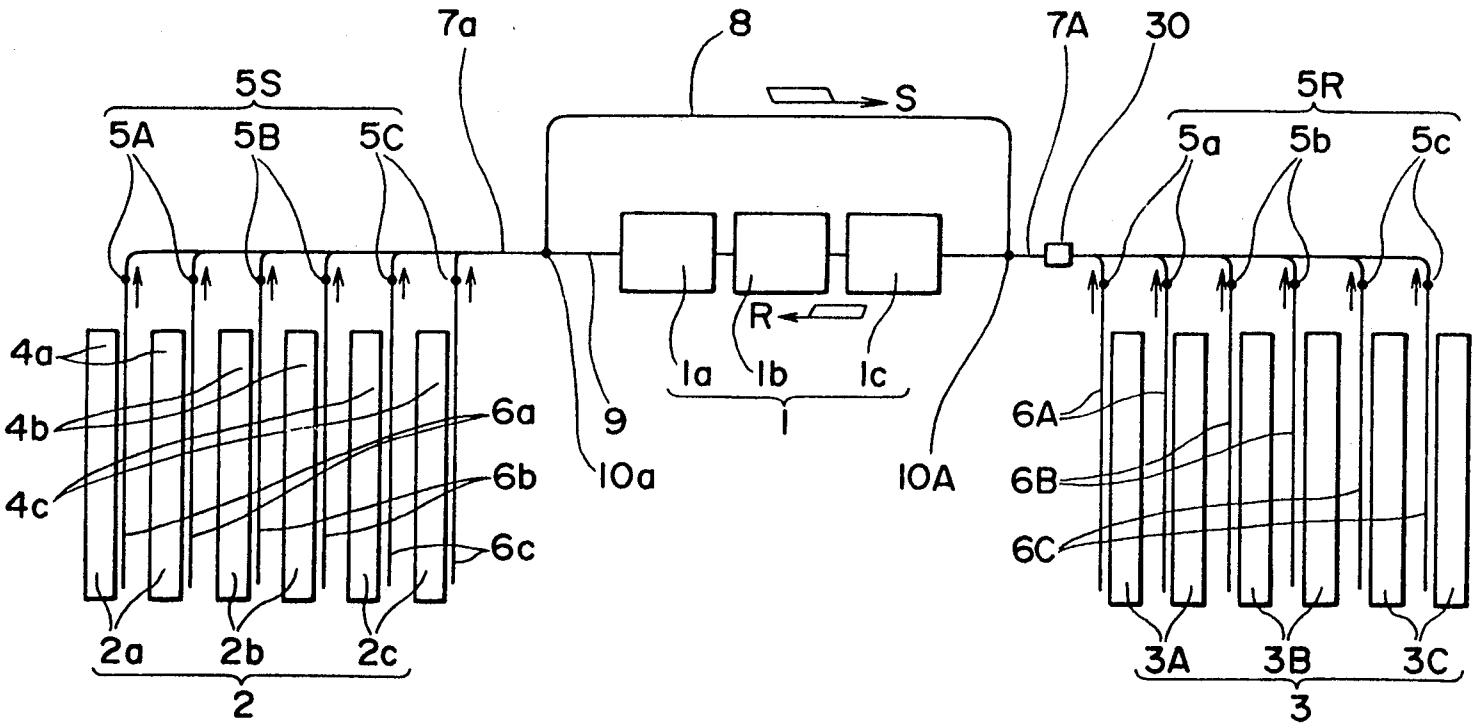
FIG. 1 is a plan of a bobbin process station in which a residual strand removing apparatus for roving bobbins of the invention is disposed.

A residual strand removing apparatus for various types of roving bobbins according to the invention will be described below in detail with reference to embodiments shown in the figures. FIG. 1 is plan illustrating a residual strand removing apparatus 1 for various types of roving bobbins as well as a roving frame group 2 and a fine spinning frame group 3 to and from which roving bobbins 5 are transferred. The roving frame group 2 is formed of roving frames 2*a*, 2*b*, 2*c*, . . . , which use full roving bobbins 5A, 5B, 5C, . . . formed of different fiber types of roving 4A, 4B, 4C, . . . wound around the bobbins, respectively. The roving bobbins 5A, 5B, 5C, . . . are moved to transfer passages 6*a*, 6*b*, 6*c*, . . . , which include rails for transferring the roving bobbins and are juxtaposed to the roving frames 2*a*, 2*b*, 2*c*, . . . , respectively. Thereby, the roving bobbins 5A, 5B, 5C, . . . are transferred to the fine spinning frame group 3. The transfer passages 6*a*, 6*b*, 6*c*, . . . are joined to one transfer passage 7*a*, which is connected through a selector 10*a* to two transfer passages 8 and 9 disposed in parallel. The transfer passages 8 and 9 are joined by a selector 10A to one transfer passage 7A. When full roving bobbins 5S including the roving bobbins 5A, 5B, 5C, . . . are transferred from the roving frame group 2 to the fine spinning frame group 3, the selectors 10*a* and 10A are controlled to transfer them through the transfer passage 8 as indicated by an arrow S, and are not transferred through the transfer passage 9. The transfer passage 7A are divided at the vicinity of the fine spinning frame group 3 to form transfer passages 6A, 6B, 6C, . . . , which extend to the fine spinning frames 3A, 3B, 3C, . . . forming the fine spinning frame group 3, respectively. A transfer line is formed of the transfer passages 6*a*, 6*b*, 6*c*, . . . , transfer passage 7*a*, transfer passages 8 and 9, transfer passage 7A and transfer passages 6A, 6B, 6C, . . .

A detecting unit 30 for various fiber types is disposed in the transfer line 7A. The detecting unit 30 detects the type or kind of the roving bobbin (5A, 5B, 5C or others) transferred from the roving frame group 2 to the fine spinning frame group 3, so that a control unit (not shown) operates to select one passage among the transfer passages 6A, 6B, 6C, . . . corresponding to the detected bobbin. The roving bobbins 5A, 5B, 5C, . . . are moved to the fine spinning frames 3A, 3B, 3C, . . . , respectively for the fine spinning.

The detecting unit 30 is designed to ottically read labels or the like, which indicate the fiber type and are attached directly to the roving bobbins 5 or, e.g., to bobbin hangers (not shown) carrying the roving bobbins 5 during transference. The detecting unit 30 may be formed of a magnetic device such as a magnetic sensor or other appropriate device.

The roving bobbins 5*a*, 5*b*, 5*c*, . . . which have been processed and spent in the fine spinning frame group 3 are moved to the transfer passages 6A, 6B, 6C, . . . and are returned to the roving frame group 2. When the bobbins are transferred from the fine spinning frame group 3 to the roving frame group 2, they pass not through the transfer passage 8 but through the transfer passage 9 as indicated by an arrow R. Except for this, the passages are opposite to those for the transfer from the roving frame group 2 to the fine spinning frame group 3. After the movement from the transfer passages 6*a*, 6*b*, 6*c*, . . . to the roving frames 2*a*, 2*b*, 2*c*, . . . , the full roving bobbins 5A, 5B, 5C, . . . are formed by winding the roving of the fiber types 4*a*, 4*b*, 4*c*, . . . around the respective bobbins, and the foregoing steps are repeated.

Residual strand removing devices 1*a*, 1*b*, 1*c*, . . . for the roving bobbins are disposed in series in the passage 9 through which the spent roving bobbins 5R including the roving bobbins 5*a*, 5*b*, 5*c*, . . . are returned from the fine spinning frame group 3 to the roving frame group 2. The residual strand removing devices 1*a*, 1*b*, 1*c*, . . . are internally provided with ducts 15 for discharging the residual strands which are connected through pipings to corresponding residual strand storages (not shown) dedicated to the various fiber types 4*a*, 4*b*, 4*c*, . . . , respectively, so that the residual strand removing devices 1*a*, 1*b*, 1*c*, . . . may send the various fiber types 4*a*, 4*b*, 4*c*, . . . of residual strands to the dedicated residual strand storages, respectively. Thus, the residual strand removing devices 1*a*, 1*b*, 1*c*, . . . are dedicated to the corresponding fiber types 4*a*, 4*b*, 4*c*, . . . , respectively.

The detecting unit 30, which is disposed in the transfer passage 7A located upstream the transfer passage 9, detects the fiber types of the residual strands of the roving bobbins 5*a*, 5*b*, 5*c*, . . . before they enter the residual strand removing devices 1*a*, 1*b*, 1*c*, . . .

The residual strand detecting device, which corresponds to the fiber type of the residual strands of the roving bobbin detected by the detecting unit 30, is operated. For this purpose, there is disposed the control unit (not shown). The control unit may be formed of an appropriate unit or device which selectively operates the residual strand removing devices corresponding to the various fiber types. Each of the residual strand removing devices 1*a*, 1*b*, 1*c*, . . . draws and removes only the residual strand of the corresponding fiber type. The residual strand removing devices 1*a*, 1*b*, 1*c*, . . . draw and remove the residual strands in a manner similar to that disclosed in the Japanese Laid-Open Utility Model Publication No. 3-92782 (1991).

Therefore, the roving of the respective fiber types of all the roving bobbins can be independently processed during the transference. The removed residual strand is opened during the drawing and is surely separated in accordance with the fiber types, so that it can be used as the raw cotton, and is supplied to the roving frame group 2 again.

Figure 2:
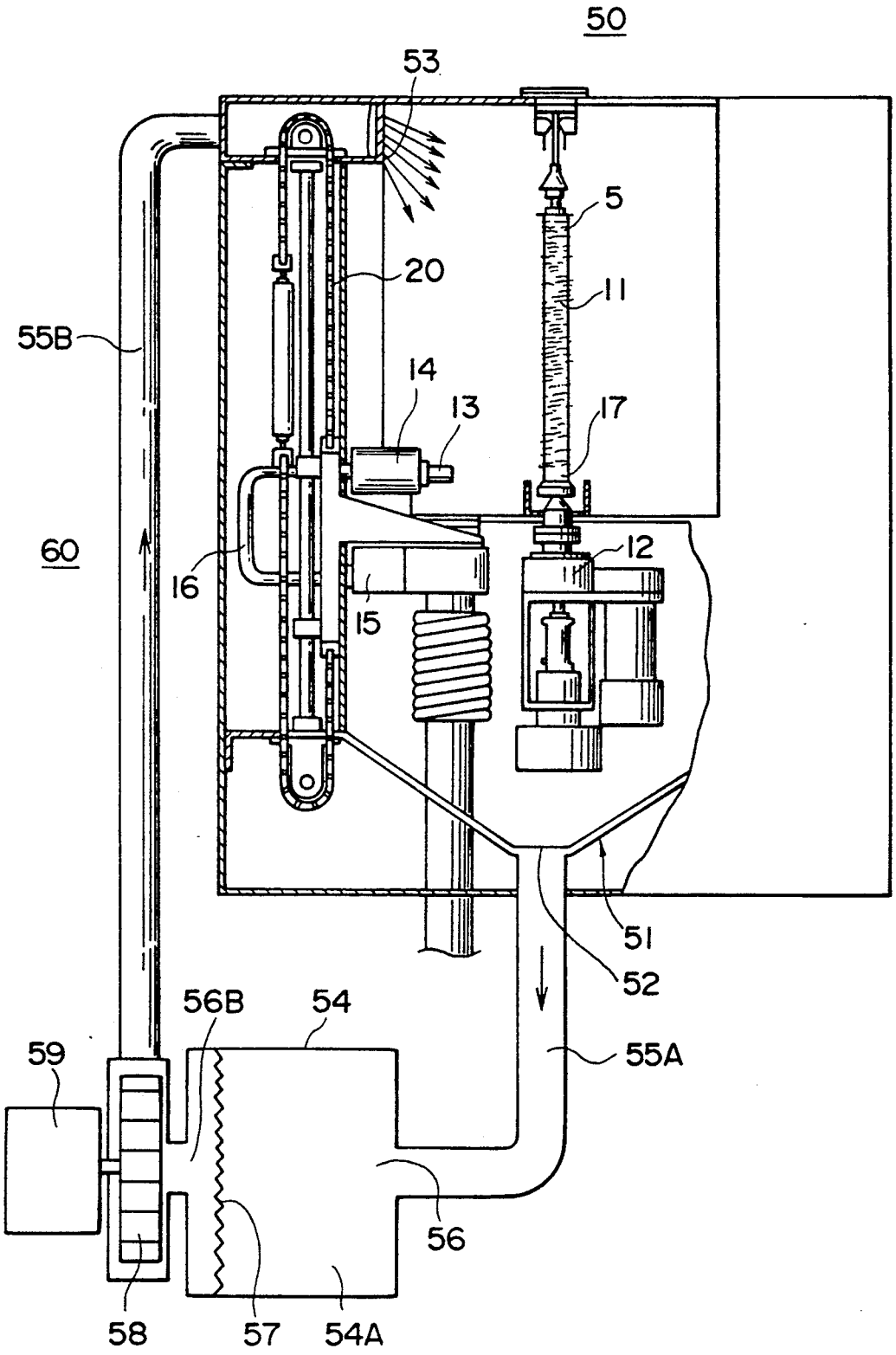
FIG. 2 is a cross section illustrating another embodiment of the invention.
Figure 3:
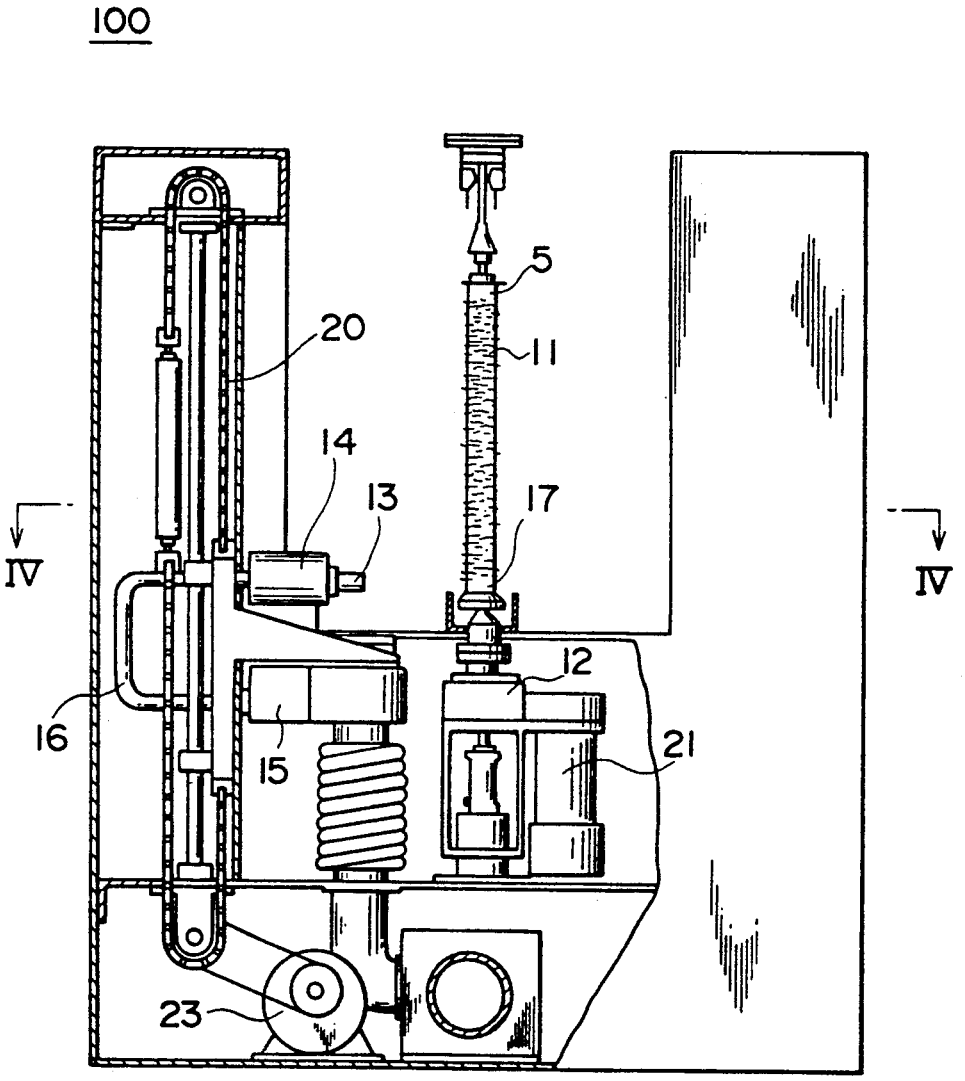
FIG. 3 is a cross section of the prior art.
Figure 4:
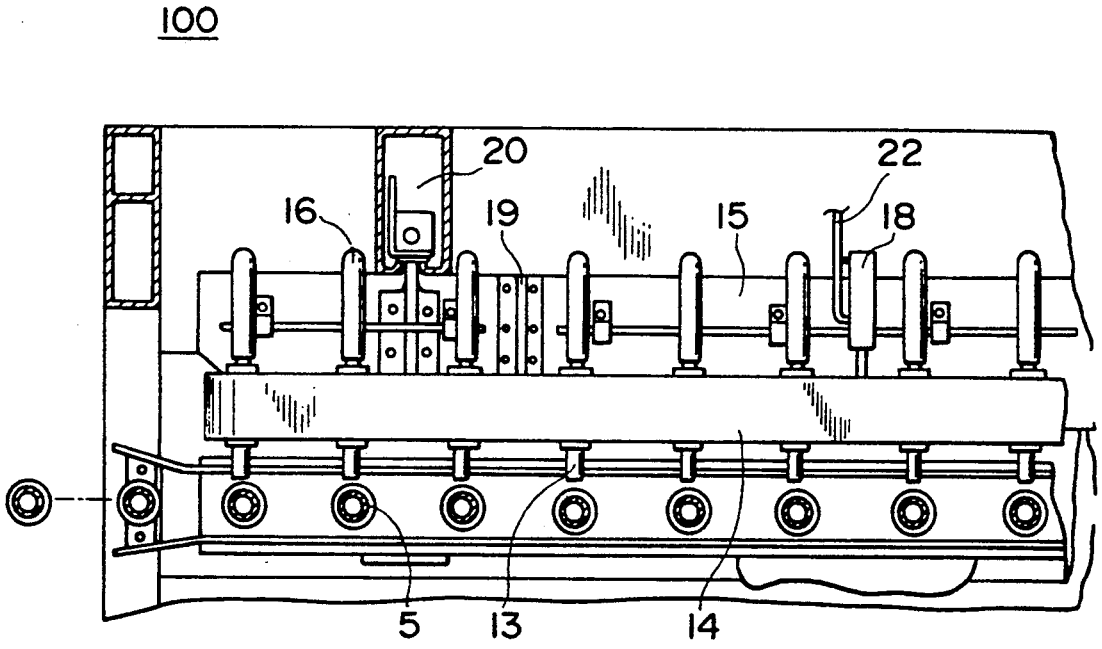
FIG. 4 is a cross section taken along line IV—IV in FIG. 3.

FIGS. 2 is a cross section illustrating another embodiment of the invention, which includes a dust collecting box and others in addition to the components of the residual strand removing device 100 in the prior art shown in FIGS. 3 and 4. A dust collecting hopper 51 having an open upper end is formed at an inner lower portion of a residual strand removing device 50. The hopper 51 is provided at its substantially central portion with a suction opening 52 and is also provided at its upper portion with an exit opening 53 which has a grille and can be connected to the exterior. The dust collecting box 54 is disposed outside and under the residual strand removing device 50, and has an inlet side 56A connected to the suction opening 52 through a lower air passage 55A and an outlet side 56B connected to the exit opening 53 through an upper air passage 55B. A residual strand collecting air passage 60 is formed of air passages including the suction opening 52, lower air passage 55A, dust collecting box 54 , upper air passage 55B and exit opening 53.

A filter 57 is disposed in the dust collecting box 54, partitioning the interior into the inlet side 56A and the outlet side 56B. A residual strand collecting portion 54A between the filter 57 and the inlet side 56A in the dust collecting box 54 serves to accumulate the residual strands 11, and the filter 57 is shifted toward the outlet side 56B for increasing the capacity of the portion 54A. In the upper air passage 55B, there is provided a blower 58 driven by an electric motor 59 for supplying the air from the lower air passage 55A toward the upper air passage 55B. The blower 58 may be disposed in any position in the residual strand collecting air passage 60, and thus may be disposed in the lower air passage 55A or the dust collecting box 54. When the residual strand 11 is removed in the residual strand removing device 50 and is drawn through the suction nozzle 13, a slight amount of residual strand may not be sufficiently drawn and thus may remain in the residual strand removing device 50. If the slight amount of residual strand thus remaining were mixed with the residual strands of the other fiber type, the quality of product would be significantly impaired. Therefore, the remaining residual strands must be completely removed, even if its quantity is very small.

When the blower 58 operates, the air in the residual strand removing device 50 is drawn through the suction opening 52, the lower air passage 55A and the inlet side 56A into the dust collecting box 54, and then passes through the filter 57 and the outlet side 56B into the upper air passage 55B. Thus, the air passes through the residual strand collecting air passage 60 and the exit opening 53 into the residual strand removing device 50. The slight amount of residual strand 11 remaining in the residual strand removing device 50 is drawn by the air through the suction opening 52 into the dust collecting box 54. However, the residual strand 11 cannot pass through the filter 57, so that it is accumulated in the residual strand collecting portion 54A located upstream the filter 57 in the dust collecting box 54. Even if the slight amount of residual strand remains in the residual strand removing device 50, the interior of the residual strand removing device 50 can be completely cleaned up by operating the blower 58 for drawing and accumulating the residual strand at the residual strand collecting portion 54A in the dust collecting box 54.

According to the invention, as described hereinbefore, the detecting unit detects the fiber types of the roving of the roving bobbin, and the residual strand removing devices disposed in series in the transfer line are selectively operated correspondingly to the fiber types, so that the residual strand of all the roving robbins which are being transferred can be completely removed by the operations carried out for the respective fiber types. Since the residual strand removing devices are disposed in series, the space can be reduced.

Since the dust collecting air passage having the filter and associated to the blower is arranged in the dust collecting box, the slight amount of residual strand which may remain in the residual strand removing device can be removed by the filter.

What is claimed is:

1. A residual strand removing apparatus for roving bobbins, disposed in a transfer line for transferring a spent roving bobbin from a fine spinning frame to a roving frame, said apparatus comprising:

a plurality of residual strand removing devices, corresponding in number to a number of fiber types of said residual strand of the roving bobbins and are disposed in series to correspond to said respective fiber types; and a control unit for selectively operating said residual strand removing device corresponding to each detected fiber type of said residual strand of said roving bobbin.

2. A residual strand removing apparatus for roving bobbins according to claim 1, wherein said residual strand removing device includes a dust collecting box, a suction opening located at a lower portion of an inner side of said residual strand removing device, an exit opening located at an upper portion of the inner side of said residual strand removing device, a lower air passage connecting said suction opening and an inlet side of said dust collecting box, an upper air passage connecting an outlet side of said dust collecting box and said exit opening, said openings and passages forming a residual strand collecting air passage, a filter disposed in said dust collecting box for partitioning the box into the inlet and outlet sides and, capable of preventing passage of the removed residual strand, and a blower for supplying air flowing from said suction opening through an interior of said dust collecting box toward said exit opening.

* * * * *